US011478948B2

(12) United States Patent
Adami

(10) Patent No.: US 11,478,948 B2
(45) Date of Patent: Oct. 25, 2022

(54) SLITTER-SCORER MACHINE WITH SUCTION SYSTEM FOR REMOVING TRIMS

(71) Applicant: FOSBER S.P.A., Pescaglia (IT)

(72) Inventor: Mauro Adami, Viareggio (IT)

(73) Assignee: Fosber S.p.A., Pescaglia (IT)

( * ) Notice: Subject to any disclaimer, the term of this patent is extended or adjusted under 35 U.S.C. 154(b) by 0 days.

(21) Appl. No.: 16/285,570

(22) Filed: Feb. 26, 2019

(65) Prior Publication Data

US 2019/0270214 A1 Sep. 5, 2019

(30) Foreign Application Priority Data

Mar. 2, 2018 (IT) ..... 102018000003218

(51) Int. Cl.

| | |
|---|---|
| ***B26D 7/18*** | (2006.01) |
| ***B26D 1/08*** | (2006.01) |
| ***B26D 7/00*** | (2006.01) |
| ***B26D 3/08*** | (2006.01) |
| ***B26D 1/24*** | (2006.01) |
| *B31B 50/16* | (2017.01) |
| *B31B 50/25* | (2017.01) |

(Continued)

(52) U.S. Cl.

CPC ..... *B26D 7/1863* (2013.01); *B26D 1/245* (2013.01); *B26D 3/08* (2013.01); *B26D 1/141* (2013.01); *B26D 1/205* (2013.01); *B26D 3/085* (2013.01); *B26D 2007/0068* (2013.01);

(Continued)

(58) Field of Classification Search

CPC ... Y10T 83/98; Y10T 83/207; Y10T 83/0207; Y10T 83/0215; Y10T 83/0222; Y10T 83/0267; Y10T 83/0289; Y10T 83/0333; Y10T 83/0363; Y10T 83/037; Y10T 83/0378; Y10T 83/0385; Y10T 83/0548; Y10T 83/2044; Y10T 83/2074; Y10T 83/2085; Y10T 83/2092; Y10T 83/2216; Y10T 83/4702; Y10T 83/6584; Y10T 83/6587; Y10T 83/6588; Y10T 83/659; Y10T 83/6595; Y10T 83/7863; Y10T 83/7868; Y10T 83/7876; Y10T 83/7872; B26D 7/1863; B26D 7/18; B26D 1/245; B26D 1/141; B26D 1/20; B26D 1/205; B26D 1/143; B26D 1/14; B26D 1/255;

(Continued)

(56) References Cited

U.S. PATENT DOCUMENTS 2,701,613 A * 2/1955 Bishop ..... B26F 1/384 83/332
4,300,421 A * 11/1981 Yano ..... B26D 7/1854 83/100

(Continued)

FOREIGN PATENT DOCUMENTS

DE 4425666 A1 1/1996
DE 10132897 A1 3/2002

(Continued)

*Primary Examiner* — Phong H Nguyen
(74) *Attorney, Agent, or Firm* — Breiner & Breiner, L.L.C.

(57) ABSTRACT

The slitter-scorer machine includes a suction unit for removing trims cut by the cutting blades. The suction unit in turn includes a first pair of suction nozzles associated with a first set of cutting tools, and a second pair of suction nozzles, associated with a second set of cutting tools. The first pair of suction nozzles is adapted to suck trims generated by the first set of cutting tools and the second pair of suction nozzles is adapted to suck trims generated by the second set of cutting tools.

10 Claims, 4 Drawing Sheets

(51) Int. Cl.
*B26D 1/20* (2006.01)
*B26D 11/00* (2006.01)
*B26D 1/14* (2006.01)

(52) U.S. Cl.
CPC ..... *B26D 2011/005* (2013.01); *B31B 50/16* (2017.08); *B31B 50/25* (2017.08)

(58) Field of Classification Search
CPC .. B26D 3/08; B26D 3/085; B26D 2007/0068; B26D 2011/005
See application file for complete search history.

(56) References Cited

U.S. PATENT DOCUMENTS 5,393,294 A * 2/1995 Jobst ..... B26D 7/18 493/227
5,496,431 A * 3/1996 Hirakawa ..... B26D 1/045 156/210
5,918,519 A * 7/1999 Schnabel ..... B31B 50/00 83/102
6,012,199 A * 1/2000 Litomisky ..... A47L 5/38 15/301
6,568,304 B2 * 5/2003 Ito ..... B31B 50/00 83/13
2001/0047704 A1 * 12/2001 Adami ..... B23D 35/008 83/34
2006/0075864 A1 * 4/2006 Adami ..... B26D 7/2635 83/469

FOREIGN PATENT DOCUMENTS

EP 0737553 A1 10/1996
EP 1344578 A2 9/2003
EP 1344578 A3 4/2006

* cited by examiner

SLITTER-SCORER MACHINE WITH SUCTION SYSTEM FOR REMOVING TRIMS

TECHNICAL FIELD

The present disclosure relates to improvements to slitter-scorer machines, i.e. to machines for scoring and slitting a continuous sheet of corrugated cardboard.

Background Art

To produce corrugated cardboard complex production lines are used, arranged along which are machines that carry out a plurality of processes on continuous paper webs, which are transformed into single sheets of corrugated cardboard. Each sheet of corrugated cardboard consists of a plurality of sheets of paper, joined to one another by gluing, at least one of which is normally smooth and at least one of which is normally corrugated.

In general, a first section of the line (called wet end) produces a continuous web of corrugated cardboard, starting from a plurality of reels of paper. In a second section of the line (called dry end) the web of corrugated cardboard is divided into a plurality of continuous strips by means of cutting tools. Each continuous strip is divided into a plurality of sheets, by means of transverse cuts. The sheets of corrugated cardboard are stacked to form stacks of sheets for packaging and transportation purposes.

Normally, the continuous strips are also subjected to a scoring operation, to obtain continuous score lines, parallel to the cutting lines and to the longitudinal extension of the strip of corrugated cardboard. The score lines are subsequently used to fold the sheets, for example to produce cardboard boxes.

Processing lines for the production of corrugated cardboard usually cornprise a slitter-scorer machine, comprising cutting tools and scoring tools to cut the continuous web of corrugated cardboard into continuous longitudinal strips, which are scored along longitudinal score lines.

In the production of corrugated cardboard it is often necessary to process single batches, also called jobs, each of which contains a certain number of sheets of corrugated cardboard. Consecutive batches usually contain sheets of different sizes and score lines in different positions from batch to batch. Consequently, passing from the processing of one batch to the processing of the subsequent batch or job it is normally necessary to move the position of the cutting lines and of the score lines according to a direction orthogonal to the longitudinal direction of the continuous web of corrugated cardboard.

To pass more quickly from one batch to the subsequent batch, in general the slitter-scorer machine comprises at least a first set of scoring tools and a second set of scoring tools. The slitter-scorer machine further comprises at least a first set of cutting tools and a second set of cutting tools. In this way, while one set of scoring tools and one set of cutting tools are operating to produce a first batch, the scoring tools of the second set of scoring tools and the cutting tools of the second set of cutting tools can be positioned according as required to process the subsequent batch.

The sets of scoring tools and of cutting tools are positioned in sequence one with respect to the other along a feed path, according to different possible configurations.

During the processing of each production batch, two cutting tools cut two lateral trims of the continuous web of corrugated cardboard. The trims are then removed. To remove the continuous trims generated by the two lateral cutting tools suction nozzles are generally used, one on each side of the feed path of the corrugated cardboard. The position of the suction nozzles can be adjustable, so as to be arranged correctly to receive the respective trim, the transverse size and transverse position of which can change in the various orders processed in sequence.

Correct insertion of the trims into the suction nozzles is an important aspect in order for production to take place continuously and without interruptions.

DE 4133760 discloses a slitter-scorer machine provided with a first cutting and scoring unit and a second cutting and scoring unit, arranged in sequence along the feed path of the corrugated cardboard. Each of the two cutting and scoring units is provided with a trim removal system, with suction nozzles and systems for adjusting their transverse position. In this way the trims are sucked by the suction nozzles immediately downstream of the point in which they are generated, i.e., immediately downstream of the cutting tools. The suction nozzles, and the related suction and transverse positioning systems are double, so that each cutting and scoring unit has suction nozzles in close proximity to the cutting tools. This solution is particularly costly.

To reduce the costs, U.S. Pat. No. 5,918,519 discloses a corrugated cardboard production line with a slitter-scorer machine, comprising in sequence: a first unit of scoring tools and of cutting tools, comprising a first set of scoring tools and a first set of cutting tools; downstream of the first unit of scoring and cutting tools, a second unit of scoring and cutting tools, comprising a second set of cutting tools and a second set of scoring tools; downstream of the first and of the second unit of scoring tools and of cutting tools, a pair of lateral cutting tools, for cutting the trims; downstream of the lateral cutting tools, a pair of suction nozzles, configured to suck the trims generated by the cuts carried out by the lateral cutting tools. In this prior art machine the lateral cutting tools form continuous trims, which are not severed between one processing batch and the next. The lateral cutting tools are always in contact with the cardboard and translate transversely to the feed path, together with the suction nozzles, to be always arranged in the correct position as a function of the batches or orders to be produced. The two units of cutting and scoring tools instead operate alternately and selectively, for the reasons described above.

The drawback of this prior art machine is, among others, that at least one of the units of cutting and scoring tools is located at a considerable distance from the lateral cutting tools. Any transverse deviations of the web and of the strips of corrugated cardboard produced by the cutting tools and scored by the scoring tools cause errors in the position and in the size of the trims. The sheets produced with these machines can therefore have significant dimensional errors.

EP 0737553 discloses a slitter-scorer machine comprising a scoring unit and, downstream thereof, a cutting unit. The scoring unit comprises two sets of scoring tools positioned in sequence along the feed path of the web of corrugated cardboard, which are activated selectively. The cutting unit comprises two sets of cutting tools, positioned in sequence along the feed path of the web of corrugated cardboard and which are activated selectively. Suction nozzles to suck the trims are arranged downstream of the cutting unit. This machine has considerable advantages with respect to those described above, in terms of efficiency, cost and smaller size. However, also in this case some problems can occur due to the distance between the scoring tools and the cutting tools selectively operating. Moreover, one of the two cutting assemblies is at a considerable distance from the suction nozzles, and therefore problems of jamming of the trims can occur.

It would therefore be desirable to provide a slitter-scorer machine that completely or partly overcomes at least one or more of the drawbacks of slitter-scorer machines of the current art. In particular, it would be beneficial to further improve the machine disclosed in EP 0737553, preserving the advantages thereof with respect to other machines of the state of the art, but further improving its performance.

SUMMARY

According to one aspect, disclosed herein is a slitter-scorer machine for scoring and slitting a web of corrugated cardboard, comprising a feed path of the corrugated cardboard. Along the feed path the machine comprises a scoring unit and a cutting unit. The latter comprises at least a first set of cutting tools and a second set of cutting tools, arranged sequentially along the feed path. Each of said first set and second set of cutting tools is adapted to cut the corrugated cardboard longitudinally into a plurality of longitudinal strips and into two lateral trims. The machine also comprises a suction unit for removing cut trims, associated with the cutting unit. Advantageously, the suction unit comprises a first pair of suction nozzles associated with the first set of cutting tools, and a second pair of suction nozzles, associated with the second set of cutting tools. In particular, the first pair of suction nozzles is adapted to suck trims generated by the first set of cutting tools and the second pair of suction nozzles is adapted to suck trims generated by the second set of cutting tools.

In practice, the cutting unit can be positioned downstream of the scoring unit.

The first set of cutting tools and the second set of cutting tools are suitably arranged in sequence, i.e., one upstream of the other, along the feed path of the corrugated cardboard. Advantageously, the suction nozzles are arranged so that the first pair of suction nozzles, associated with the first set of cutting tools, is arranged, with respect to the feed path, between the first set of cutting tools and the second set of cutting tools. Vice versa, the second pair of suction nozzles is positioned adjacent to the second set of cutting tools, downstream thereof, along the feed path of the corrugated cardboard.

In practice, the first set of cutting tools and the second set of cutting tools can each comprise a plurality of cutting tools, for example disc-shaped blades, which can selectively be taken to an operating position or an idle position and positioned in specific points in transverse direction with respect to the direction of the feed path. The cutting tools of each set that are taken to an operating position can be approximately co-axial. In general, each set of cutting tools can have a number of cutting tools such that in some cases some of them remain idle, depending upon the number of strips into which the corrugated cardboard must be cut in the various processing orders.

In general, contrary to some more complex and costly machines of the current art, the trims are cut by two tools of the first or of the second set of tools, which are in the end lateral positions, i.e. the outermost positions with respect to the centerline of the corrugated cardboard being fed along the feed path. Therefore, when a set of cutting tools is taken to the idle position and the other is taken to the operating position, during the passage from one production batch to the other, the tools that generate the trims also change. This avoids having to provide a pair of auxiliary cutting tools, always in contact with the corrugated cardboard, the sole object of which is to cut the trims, and which must be able to move transversely to the feed path.

In general, unless otherwise indicated, in the present context the terms "upstream" and "downstream" refer to the direction of feed, i.e. to the direction in which the corrugated cardboard moves along the feed path.

Therefore, according to advantageous embodiments described herein, the suction nozzles are arranged directly adjacent to, i.e., immediately and directly downstream of, the respective set of cutting tools. As will be more apparent from the detailed description of embodiments, in this way more efficient control of the trims is achieved and a particularly compact machine with limited cost is produced.

In advantageous embodiments, the two suction nozzles of each of said first and second pair of suction nozzles are movable transversely to the feed path to adapt to the position of the trims generated by the respective first and second set of cutting tools.

In advantageous embodiments, the suction nozzles of the first pair of suction nozzles can be adapted to move transversely to the feed path symmetrically to one another, and the suction nozzles of the second pair of suction nozzles can be adapted to move transversely to the feed path symmetrically to one another. This can allow simplification of the regulation mechanism, as it is possible, for example, to use a single motor that acts on a pair of opposed racks, or on a threaded bar with opposed threaded portions, with which symmetrical slides carrying the two nozzles of one pair or of each pair mesh.

To further simplify the structure of the machine, a first suction nozzle of the first pair of suction nozzles can be rigidly connected to a first suction nozzle of the second pair of suction nozzles; and a second suction nozzle of the first pair of suction nozzles can be rigidly connected to a second suction nozzle of the second pair of suction nozzles. Moreover, the respective first suction nozzles of the first and of the second pair of suction nozzles can be positioned on a first side of the feed path, and the respective second suction nozzles of the first and of the second pair of suction nozzles can be positioned on a second side of the feed path. By associating the first nozzles of each pair and the second nozzles of each pair with each other in this way, it is possible to support the four nozzles in an extremely simple way and to move them with a single actuator for adjusting their position with respect to the position of the cutting tools, and therefore as a function of the position and of the size of the trims.

To obtain further simplifications and greater compactness, the first pair of suction nozzles and the second pair of suction nozzles can be in communication with a common suction system.

For example, the suction system can comprise selector members, to generate suction selectively through the first pair of suction nozzles and through the second pair of suction nozzles, according to which of these pairs is active.

Further advantageous features and embodiments of the slitter-scorer machine are described hereunder and defined in the accompanying claims.

BRIEF DESCRIPTION OF THE DRAWINGS

The invention will be better understood by following the description and accompanying drawings, which show a non-limiting exemplary embodiment of a slitter-scorer. More in particular, in the drawing.

DETAILED DESCRIPTION OF EMBODIMENTS

In brief, the slitter-scorer machine described herein comprises a cutting unit with two sets of cutting tools arranged in sequence along the feed path of the corrugated cardboard, said sets of cutting tools operating alternately. While a first set of cutting tools is operating to produce a batch or job of cardboard sheets, the other set of cutting tools is set up to process the subsequent batch or job. Positioning robots can be provided for this purpose.

To efficiently remove the trims, two pairs of suction nozzles are provided associated with the respective two assemblies of cutting tools and placed closely adjacent thereto. In this way the pick-up point of the trims is immediately downstream of the point in which they are generated by the cutting tools time by time in operating condition. To reduce the overall cost of the machine, the two pairs of nozzles are configured as a single unit, in the sense that they are supported by the same transverse support elements, are translated transversely to the feed path by the same translation means, and can be associated with the same suction means. In practice, the suction system for the removal of trims is single and only the pairs di nozzles are double, to operate in positions closely adjacent to the cutting tools of the two assemblies. In this way, an economical, compact and low cost system is obtained, but which at the same time ensures efficient removal of the trims.

Figure 1:
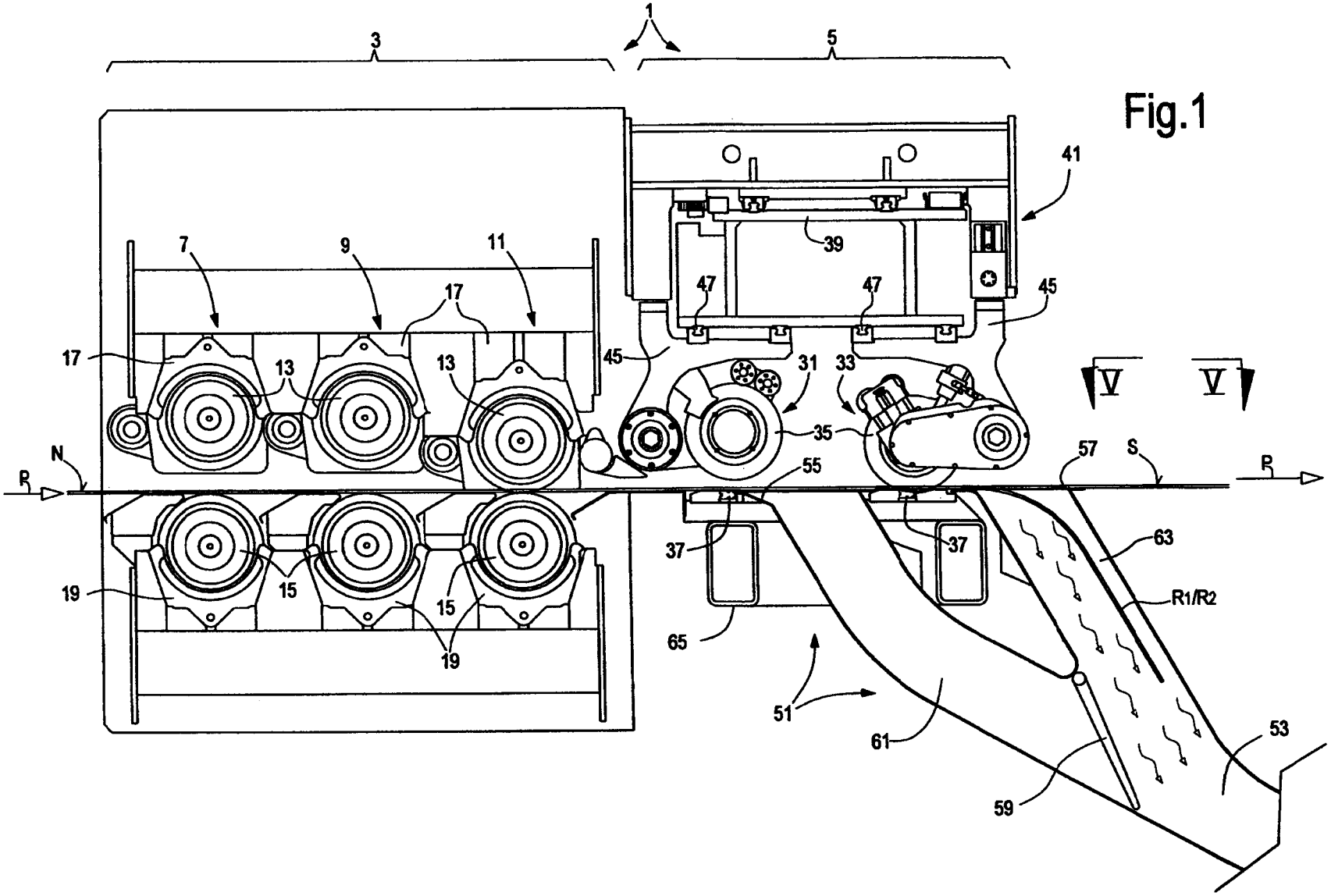
FIG. 1 shows a side view of a slitter-scorer machine according to the present description in a first operating condition.

Referring now to the accompanying drawings, with initial reference to FIG. 1, the slitter-scorer machine 1 is positioned along a feed path P of a web of corrugated cardboard N. The web of corrugated cardboard N is fed according to the arrow P and passes through the slitter-scorer machine 1, along which the web of corrugated cardboard N is divided into a plurality of strips S. Each strip can be scored along longitudinal score lines. Longitudinal direction, in the present context, is intended as the direction parallel to the feed path P.

In the illustrated embodiment, the slitter-scorer machine 1 comprises a scoring unit 3 and a cutting unit 5. In some embodiments, the scoring unit 3 can be positioned upstream of the cutting unit 5 with respect to the direction of feed P of the web of corrugated cardboard N and of the strips of corrugated cardboard S along the feed path P.

The scoring unit 3 can comprise a plurality of sets of scoring tools. Preferably, the scoring unit 3 comprises at least two sets of scoring tools. In the example illustrated, the scoring unit 3 comprises a first set of scoring tools 7, a second set of scoring tools 9 and a third set of scoring tools 11, arranged in sequence along the feed path P. Each set of scoring tools comprises a plurality of pairs of scoring tools 13, 15, positioned above and below the feed path P of the corrugated cardboard N. In FIG. 1 a single upper scoring tool 13 and a single lower scoring tool 15 can be seen for each set of scoring tools 7, 9, 11, as the scoring tools are aligned along a direction orthogonal to the feed path P.

Each upper scoring tool 13 can be positioned transversely to the feed path P by means of robots 17 and each lower scoring tool 15 can be positioned transversely to the feed path P by means of robots 19. In general, some and not necessarily all of the scoring tools of one set 7, 9, 11 are operating, while the scoring tools of the other sets are standing by and can be positioned by the respective robots 17, 19 as a function of the requirements of the subsequent processing batch. In the layout of FIG. 1, the scoring tools 13 of the first and of the second set 7, 9 of scoring tools are standing by and the upper (13) and lower (15) scoring tools of each pair are spaced from each other, while the scoring tools of the third set 11 are operating and the tools of each pair of upper (13) and lower (15) scoring tools are pressed against each other to score the corrugated cardboard N that passes between them.

Likewise, the cutting unit 5 comprises at least two sets of cutting tools indicated with 31 and 33, arranged in sequence along the feed path P. In the embodiment illustrated, each set of cutting tools 31, 33 comprises a plurality of cutting tools, only one of which is visible in FIG. 1, as the cutting tools of each set are aligned with each other according to a direction orthogonal to the feed path P.

In the illustrated embodiment, each cutting tool comprises a disc-shaped cutting tool 35, co-acting with a counter-blade 37. In the embodiment illustrated in FIG. 1, the counter-blades 37 are located under the feed path, while the rotation axes of the cutting tools 35 are located above the feed path P. A fixed load-bearing structure 39 can carry one or more robots 41 that position the cutting tools 35 in the direction transverse to the feed path P. Each cutting tool 35 can for example be carried by a respective slide 45 movable along guides 47 and lockable in a position selectively preselected as a function of the characteristics of the batch to be produced.

In other embodiments, the cutting tools can comprise pairs of rotating disc-shaped blades and counter-blades, rather than rotating blades and fixed counter-blades.

In the layout of FIG. 1, at least some of the cutting tools 35 of the set of cutting tools 33 are operating and co-act with the respective counter-blade 37, to slit the corrugated cardboard N into longitudinal strips S, while the cutting tools 35 of the set of cutting tools 31 are in idle position, raised above the respective counter-blade 37 and can be displaced transversely to the feed path P.

In general, each set of tools can comprise a large number of tools, which are not always all operating. The number of cutting tools and of scoring tools that are operating each time depends on the number of cutting lines and on the number of score lines that are required by the single production batch.

Figure 5:
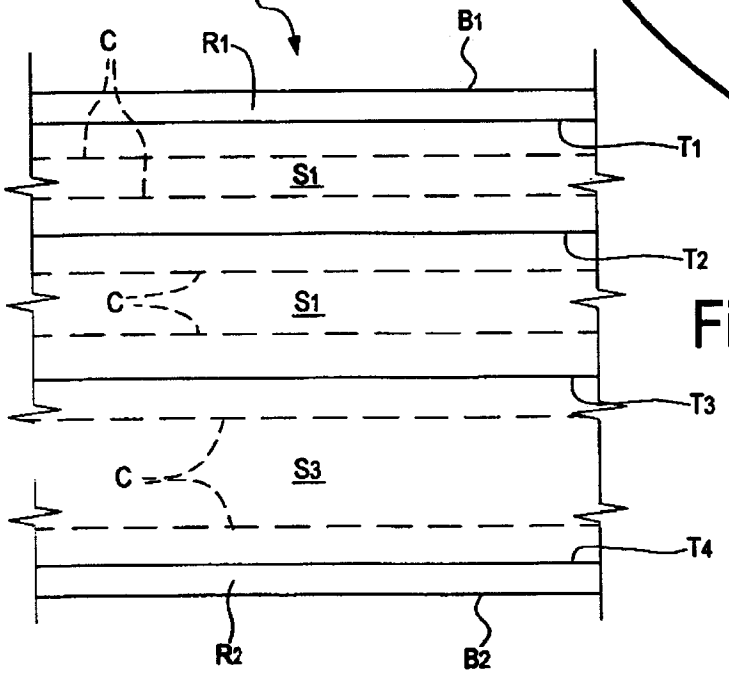
FIG. 5 shows a schematic plan view along the line V-V of FIG. 1, of a portion of corrugated cardboard divided into longitudinal strips and trims.

In general, it is the two outermost of the cutting tools 35 that are operating that generate two lateral trims, which must be eliminated. FIG. 5 shows a plan view, along the line V-V of FIG. 1, of a portion of web of corrugated cardboard N, having longitudinal edges B1, B2 and divided by cutting lines T1, T2, T3 and T4 into three longitudinal strips S1, S2, S3 of corrugated cardboard and into two lateral trims R1, R2, which must be eliminated. Each strip S1, S2, S3 of corrugated cardboard can have longitudinal score lines C parallel to the cutting lines T1, T2, T3, T4. The number of cutting lines and of score lines is purely by way of example.

Figure 2:
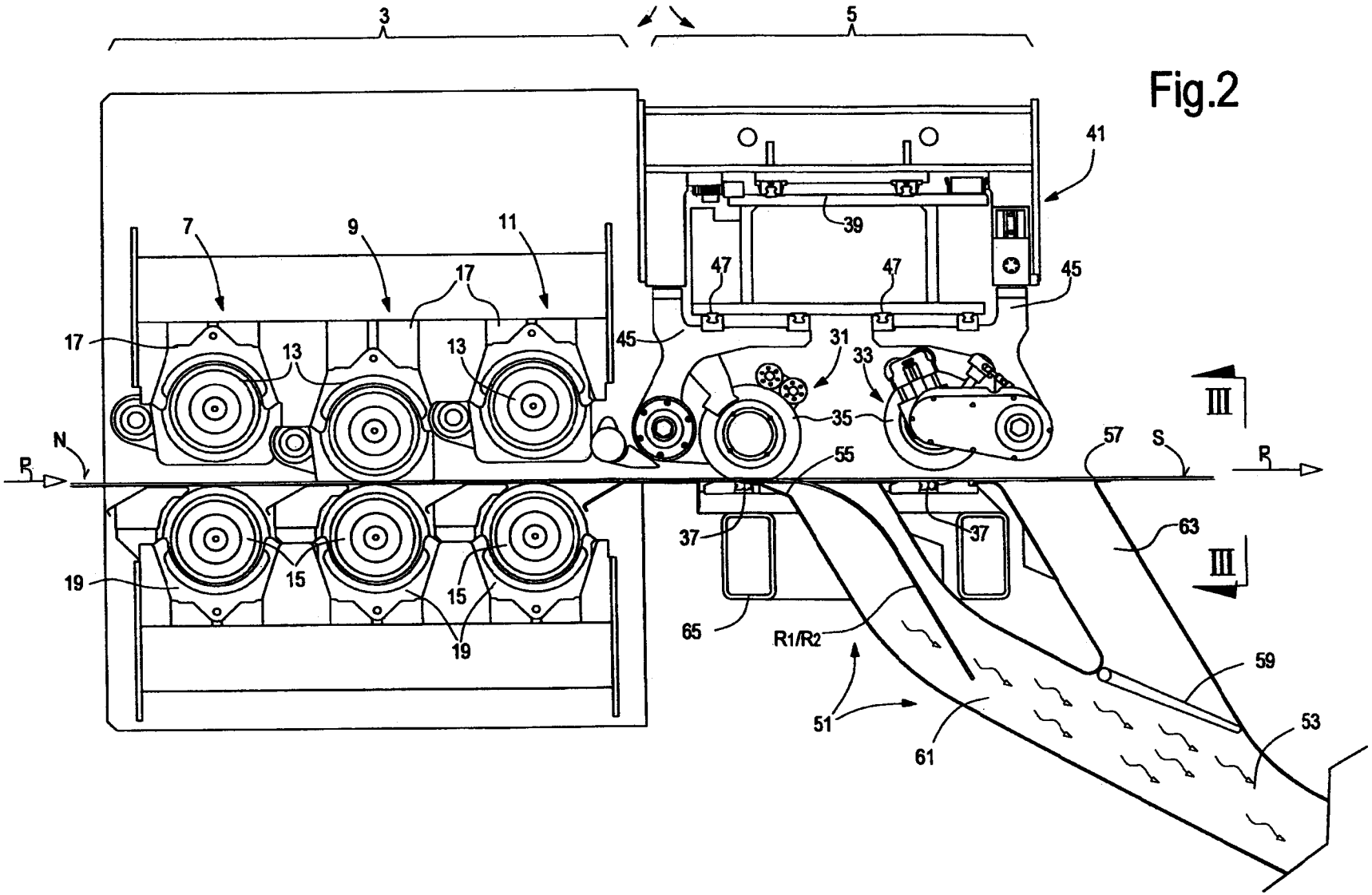
FIG. 2 shows a side view identical to the view of FIG. 1, in a second operating condition.

While in the operating condition of FIG. 1 the set of cutting tools 33 is in operating condition and the set of cutting tools 31 is idle, in the operating condition of FIG. 2 the situation is reversed, with the set of cutting tools 31 operating and the set of cutting tools 33 idle. In the example illustrated, in the condition of FIG. 2 the set of scoring tools 11 is idle and the set of scoring tools 9 is operating. The two operating conditions of FIGS. 1 and 2 show the processing of two different processing jobs or batches. In general, the trims R1, R2 of the two processing orders can be in different positions and can have different transverse sizes, i.e., widths.

Figure 3:
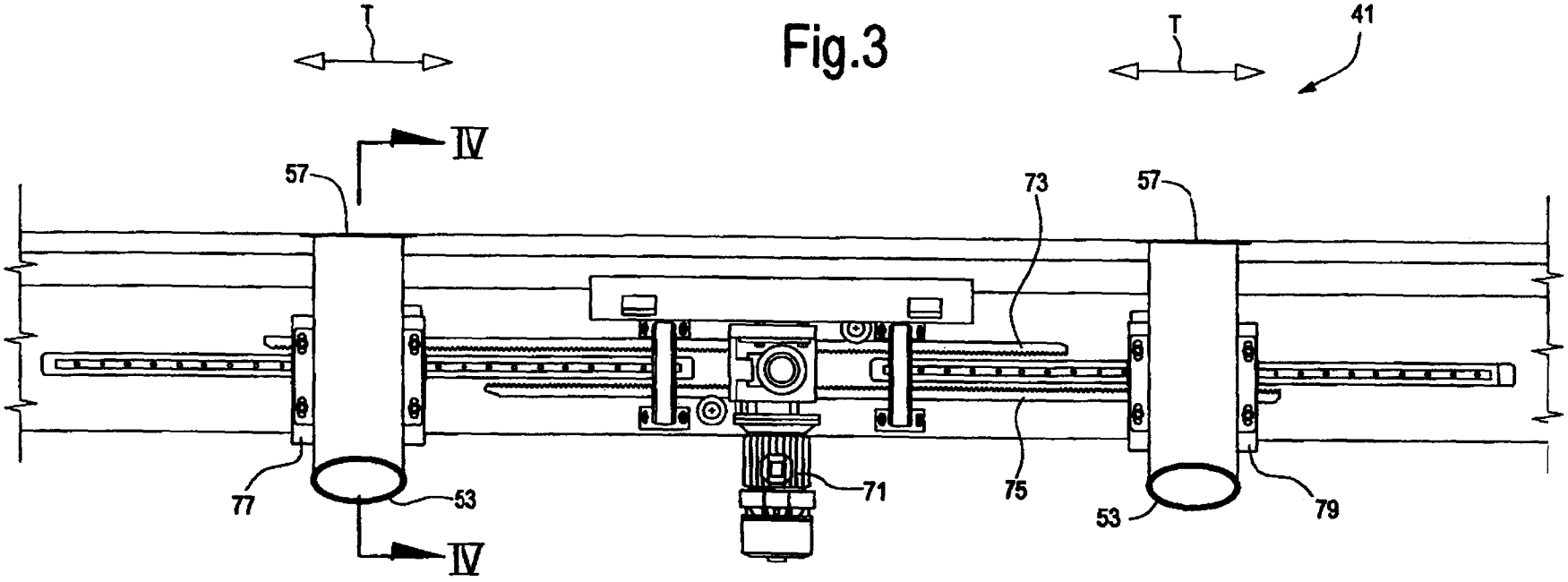
FIG. 3 shows a schematic partial view along the line of FIGS. 1 and 2.

In the illustrated embodiment a suction unit, indicated as a whole with 51, provided with suction nozzles as described hereunder, is provided for removing the trims R1, R2 continuously. More in particular, the suction unit 51 comprises a pair of suction ducts 53 shown in FIG. 3. The two suction ducts 51 are positioned on the two opposite sides of the feed path P.

Each suction duct 53 can be fluidly coupled with one or other of two suction nozzles positioned in sequence along the feed path P of the corrugated cardboard N and on the same side of the feed path P.

In practice, a first suction nozzle 55, adjacent to the first set of cutting tools 55, and a second suction nozzle 57, adjacent to the second set of cutting tools 33 are provided on each side of the feed path P. Therefore, a first pair of suction nozzles 55 is arranged directly downstream of the first set of cutting tools 31 and is adapted to suck trims R1, R2 generated by the first set of cutting tools 31. A second pair of suction nozzles 57 is arranged directly downstream of the second set of cutting tools 33 and is adapted to suck trims R1, R2 generated by the second set of cutting tools 33.

Advantageously, the suction nozzles 55, 57 of each side are connectable with the respective suction duct 53. A selector member, for example a valve 59, positioned in the suction path, selectively connects one or the other of the two suction nozzles 55, 57 of the same side with the respective suction duct 53. On each side of the feed path, a suction connector 61 connects the suction duct 53 to the suction nozzle 55 and a suction connector 63 connects the suction duct 53 to the suction nozzle 57.

Therefore, a common suction system, formed by the two suction ducts 53 and by the suction connectors 61, 63 can selectively generate suction through the pair of suction nozzles 55 and the pair of suction nozzles 57, simply by shifting the selector members 59.

The four nozzles can advantageously be carried by a common load-bearing structure 65. Moreover, the two suction nozzles 55, 57 on each side of the feed path P can be integral with each other, so as to be able to be translated integrally in transverse direction according to the double arrow T, see FIG. 3. The suction nozzles 55, 57 located on a first side of the feed path P can be adjusted in position according to the double arrow T to be correctly positioned in transverse direction, i.e., orthogonal to the feed path P. Likewise, the suction nozzles 55, 57 located on the second side of the feed path P can be adjusted in position according to the double arrow T. In general, the nozzles are adjusted to be in the correct position with respect to the point in which the trims R1, R2 are formed.

Figure 4:
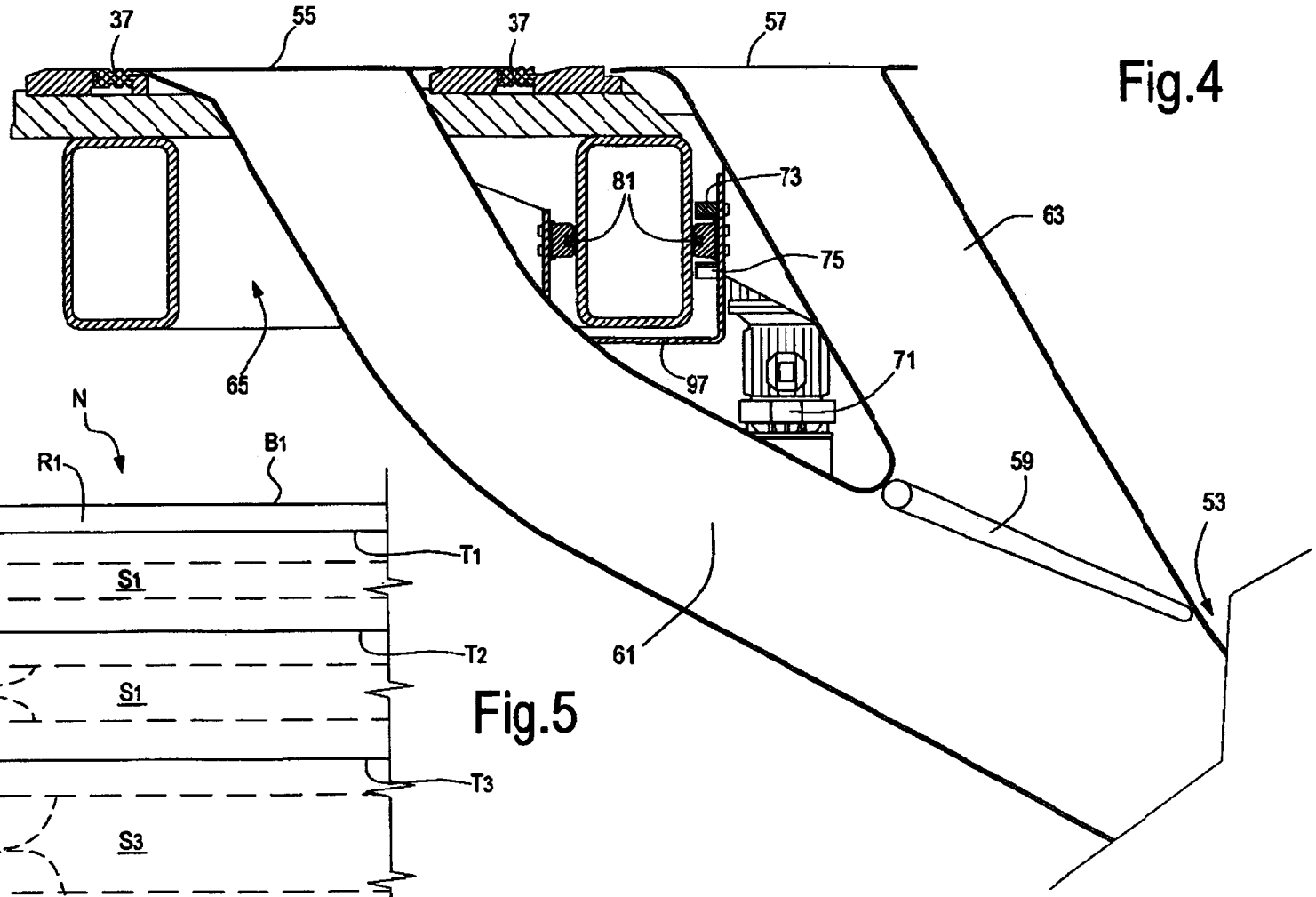
FIG. 4 shows an enlarged section along the line IV-IV of FIG. 3.

In advantageous embodiments, the adjustment movement according to the double arrow T is carried out symmetrically for the nozzles of the two sides of the feed path P. Preferably, a single actuator, for example an electric motor, is provided to carry out the movement to adjust all the suction nozzles. In the embodiment illustrated in the accompanying drawings, see in particular FIG. 3, a motor 71 is provided, supported by the load-bearing structure 65, in an approximately central position between the nozzles 55, 57 of the two sides of the feed path P. An output pinion of the motor 71, not shown, meshes with two racks 73, 75, integral respectively with a first slide 77 and with a second slide 79. The first slide 77 supports the two nozzles 55, 57 on one side of the feed path P and the second slide supports the two nozzles 55, 57 on the other side of the feed path P. In the illustrated example the slides 77, 79 are supported by a pair of transverse guides 81 (see also FIG. 4) integral with the load-bearing structure 65.

With this arrangement, the motor 71 can symmetrically and simultaneously adjust the nozzles 55, 57 on the two sides of the feed path P. In this way an efficient, economical and compact system for suction and removal of the trims R1, R2 is obtained. In fact, the suction nozzles 55, 57 are located directly adjacent to the cutting tools 35. When the cutting tools of the set of cutting tools 31 are operating, the selector members 59 place the nozzles 55 of the first pair of suction nozzles in fluid connection with the suction ducts 53. When the cutting tools of the second set of cutting tools 33 are operating, the selector members 59 place the nozzles 57 of the second pair of suction nozzles in fluid connection with the suction ducts 53.

Therefore, in all operating conditions the active suction nozzles are located directly downstream of the cutting tools that generate the trims, avoiding risks of deviation or breaking of the trims and consequent loss thereof. Moreover, even if the trims formed are not continuous, but are severed between one process order and the next, their heads, i.e., the leading edges of the trims, are easily inserted into the respective suction nozzles.

The suctions systems and the devices for adjusting the suction nozzles are substantially the same as those required by a machine with only one pair of suction nozzles, and are thus compact and low cost, besides being easily controllable with a single regulation actuator.

What is claimed:

1. A slitter-scorer machine for scoring and slitting a corrugated cardboard web, comprising:

a feed path of the corrugated cardboard web; and arranged in either upstream sequence or in downstream sequence along the feed path, a scoring unit and a slitting unit;

wherein the slitting unit includes in sequence along the feed path through the slitting unit at least two sets of cutting tools comprising at least a first set of cutting tools and a second set of cutting tools arranged downstream of the first set of cutting tools with respect to a direction of advancement of the corrugated cardboard web along the feed path, wherein each of said first set of cutting tools and said second set of cutting tools is adapted to cut the corrugated cardboard web longitudinally into a plurality of longitudinal strips and into two lateral trims;

and, associated with the slitting unit, a suction unit for removing said two lateral trims, wherein the suction unit comprises a first pair of suction nozzles associated with the first set of cutting tools and arranged between the first set of cutting tools and the second set of cutting tools, and a second pair of suction nozzles, associated with the second set of cutting tools and arranged downstream of the second set of cutting tools with respect to the direction of advancement of the corrugated cardboard; wherein the first pair of suction nozzles is adapted to suck leading edges of continuous trims and leading edges of discontinuous trims generated by the first set of cutting tools and the second pair of suction nozzles is adapted to suck leading edges of continuous trims and leading edges of discontinuous trims generated by the second set of cutting tools;

wherein a first suction nozzle of the first pair of suction nozzles is rigidly connected to a first suction nozzle of the second pair of suction nozzles; and wherein a second suction nozzle of the first pair of suction nozzles is rigidly connected to a second suction nozzle of the second pair of suction nozzles; wherein the respective first suction nozzles of the first pair of suction nozzles and of the second pair of suction nozzles are positioned on a first side of the feed path, and the respective second suction nozzles of the first pair of suction nozzles and of the second pair of suction nozzles are positioned on a second side of the feed path;

and wherein each respective one of the first suction nozzle of the first pair of suction nozzles and the first suction nozzle of the second pair of suction nozzles are movable together as a single unit transversely to the feed path, and each respective one of the second suction nozzle of the first pair of suction nozzles and the second suction nozzle of the second pair of suction nozzles are movable together as a single unit transversely to the feed path to adapt to the position of the trims generated by respective ones of said first set of cutting tools and said second set of cutting tools.

2. The slitter-scorer machine of claim 1, wherein the slitting unit is positioned downstream of the scoring unit; and wherein a single actuator provides movement to simultaneously adjust nozzles of the first pair of suction nozzles and nozzles of the second pair of suction nozzles transversely to the feed path.

3. The slitter-scorer machine of claim 1, wherein the suction nozzles of the first pair of suction nozzles are adapted to move transversely to the feed path symmetrically to one another; and wherein the suction nozzles of the second pair of suction nozzles are adapted to move transversely to the feed path symmetrically to one another.

4. The slitter-scorer machine of claim 1, wherein the first pair of suction nozzles and the second pair of suction nozzles are in communication with a common suction system.

5. The slitter-scorer machine of claim 4, wherein the common suction system comprises selector members, to generate suction selectively through the first pair of suction nozzles and through the second pair of suction nozzles.

6. The slitter-scorer machine of claim 4, wherein the common suction system comprises:

a first suction duct fluidly coupled to a first suction nozzle of the first pair of suction nozzles and to a first suction nozzle of the second pair of suction nozzles;

a second suction duct fluidly coupled to a second suction nozzle of the first pair of suction nozzles and to a second suction nozzle of the second pair of suction nozzles;

wherein the respective first suction nozzle of the first pair of suction nozzles and of the second pair of suction nozzles are positioned on a first side of the feed path, and the respective second suction nozzle of the first pair of suction nozzles and of the second pair of suction nozzles are positioned on a second side of the feed path.

7. The slitter-scorer machine of claim 1, comprising, on each side of the feed path, a respective slide, and wherein each said respective slide supports a suction nozzle of the first pair of suction nozzles and a suction nozzle of the second pair of suction nozzles.

8. The slitter-scorer machine of claim 7, wherein each said respective slide is movable along a system of common guides integral with a load-bearing structure.

9. The slitter-scorer machine of claim 1, wherein the scoring unit comprises a plurality of scoring sets positioned in sequence along the feed path and adapted to be activated selectively.

10. A slitter-scorer machine for scoring and slitting a corrugated cardboard web, comprising:

a feed path of the corrugated cardboard web; and arranged in either upstream sequence or in downstream sequence along the feed path, a scoring unit and a slitting unit;

wherein the slitting unit includes in sequence along the feed path through the slitting unit at least two sets of cutting tools comprising at least a first set of cutting tools and a second set of cutting tools arranged downstream of the first set of cutting tools with respect to a direction of advancement of the corrugated cardboard web along the feed path, wherein each of said first set of cutting tools and said second set of cutting tools is adapted to cut the corrugated cardboard web longitudinally into a plurality of longitudinal strips and into two lateral trims;

and, associated with the slitting unit, a suction unit for removing said two lateral trims, wherein the suction unit comprises a first pair of suction nozzles associated with the first set of cutting tools and arranged between the first set of cutting tools and the second set of cutting tools, and a second pair of suction nozzles, associated with the second set of cutting tools and arranged downstream of the second set of cutting tools with respect to the direction of advancement of the corrugated cardboard web; wherein the first pair of suction nozzles is adapted to suck leading edges of continuous trims and leading edges of discontinuous trims generated by the first set of cutting tools and the second pair of suction nozzles is adapted to suck leading edges of continuous trims and leading edges of discontinuous trims generated by the second set of cutting tools;

wherein each suction nozzle of said first pair of suction nozzles and of said second pair of suction nozzles are movable transversely to the feed path, to adapt to the position of the trims generated by respective ones of said first set of cutting tools and said second set of cutting tools; and further comprising a single actuator to provide movement to simultaneously adjust nozzles of the first pair of suction nozzles and nozzles of the second pair of suction nozzles transversely to the feed path.

* * * * *